United States Patent [19]

Wakita et al.

[11] 4,152,893

[45] May 8, 1979

[54] INTERNAL COMBUSTION ENGINE SECONDARY AIR CONTROL SYSTEM

[75] Inventors: Nobuaki Wakita; Ryuichi Deguchi, both of Susono, Japan

[73] Assignee: Toyota Jidosha Kogyo Kabushiki Kaisha, Toyota, Japan

[21] Appl. No.: 799,255

[22] Filed: May 23, 1977

[30] Foreign Application Priority Data

Jan. 6, 1977 [JP] Japan ..... 52-238

[51] Int. Cl.[2] ..... F01N 3/10

[52] U.S. Cl. ..... 60/290; 137/469

[58] Field of Search ..... 60/290, 289; 137/469

[56] References Cited

U.S. PATENT DOCUMENTS

| | | | |
|---|---|---|---|
| 2,295,931 | 9/1942 | Caminez | 137/469 |
| 2,888,946 | 6/1959 | Barron | 137/469 |
| 3,373,764 | 3/1968 | Munn | 137/469 |
| 3,430,437 | 3/1969 | Saussele | 60/290 |
| 3,812,673 | 5/1974 | Muroki | 60/290 |
| 4,046,163 | 9/1977 | Novak | 137/469 |

FOREIGN PATENT DOCUMENTS

| | | | |
|---|---|---|---|
| 2235596 | 2/1973 | Fed. Rep. of Germany | 60/290 |

*Primary Examiner*—Douglas Hart

[57] ABSTRACT

A secondary air control system for an internal combustion engine having an exhaust system provided with exhaust gas treating means adapted for secondary air injection and including a relief valve includes a mechanism which keeps the relief valve open after the valve is opened by a predetermined pump discharge pressure, until a predetermined lower pressure is reached.

7 Claims, 5 Drawing Figures

INTERNAL COMBUSTION ENGINE SECONDARY AIR CONTROL SYSTEM

BACKGROUND OF THE INVENTION

This invention relates in general to a secondary air control system for an internal combustion engine, and more particularly to a secondary air control system having a relief valve adapted to open when the discharge pressure of an air pump for secondary air supply reaches a predetermined level and to remain open until the pump discharge pressure decreases to a lower level.

DESCRIPTION OF THE PRIOR ART

Internal combustion engines employ a variety of systems for injecting secondary air in the vicinity of the exhaust valves for the purpose of making exhaust gas harmless by oxidizing noxious contents resulting from burning in the combustion chambers.

One of such systems is of the air injection mode wherein, with the intake manihold vacuum used as an acting medium, the pressurized air from an air pump driven by the engine is injected as secondary air into the exhaust system by controlling an air switching valve. Such air injection system usually has a relief valve provided in the secondary air passageway to regulate the air pressure therein so as to control the rate of air flow from the pump or to ensure pump durability.

Generally the actuating pressure for the relief valve is set at a point of compromise between secondary air flow requirement and air pump protecting condition. The demand for more secondary air along with stricter exhaust gas control can simply be met by raising the pressure setting for the relief valve. This counter-plan, however, is restricted from the viewpoint of air pump protection, so that conventional systems have encountered extreme difficulty in setting conditions which fulfil both flow and protection requirements.

SUMMARY OF THE INVENTION

Such difficulty can be eliminated by the present invention, which aims to set the discharge pressure of the air pump at a sufficiently high level to provide a required air flow rate (the discharge pressure at the time when the relief valve starts opening) and to simultaneously hold the discharge pressure of the air pump running at the highest allowable rotating speed to a pressure level which allows the internal temperature of the air pump to stay under its allowable temperature limit, by providing a system including a mechanism adapted to control the relief passage so as to keep the relief valve open until the secondary air pressure decreases to a predetermined valve-closing pressure lower than the valve-opening pressure after the relief valve is opened by the latter, thereby ensuring required secondary air supply and endurance of the air pump during high speed operation.

The present invention contemplates providing a relief valve with those operating characteristics which are not intended to keep the air pump discharge pressure constant but are well suited to requirements of the associated system.

The invention thus provides such arrangement that a system for secondary air injection into the exhaust system of an internal combustion engine includes a relief valve which starts opening at a relatively high pressure setting and subsequently remains full open until it closes at a lower pressure, thereby effectively ensuring supply of required amounts of secondary air than in the prior art and endurance of the air pump during high speed rotation.

DETAILED DESCRIPTION OF PREFERRED EMBODIMENTS

Figure 1:
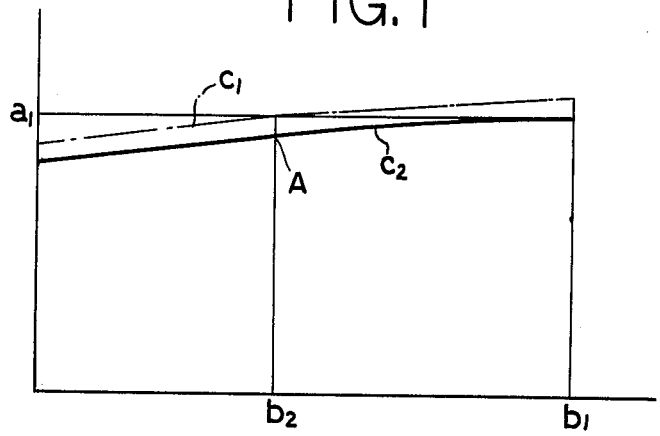
FIG. 1 illustrates discharge air temperature characteristics of an air pump.

Referring now to the appended drawings, and particularly to FIG. 1, the ordinate and abscissa stand respectively for the discharge air temperature of an air pump and the rotating speed of the pump. The symbol $a_1$ designates the allowable discharge air temperature limit of the air pump, $b_1$ represents the maximum rotating speed of the air pump, $b_2$ represents the rotating speed of the pump at the time when a relief valve starts opening, and $c_1$, $c_2$, . . . refer to discharge pressure levels of the pump, with the assumption that $c_1 > c_2$, . . . . Generally, with the discharge pressure fixed, the air temperature gradually increases with the increase of the rotating speed as shown in the figure. The allowable discharge air temperature of the air pump at the maximum rotating speed determines the allowable discharge air pressure, so that the air temperature at the revolving speed $b_2$ when the opening of the relief valve is to to be started is at the point A on the line of the discharge pressure $c_2$.

Figure 2:
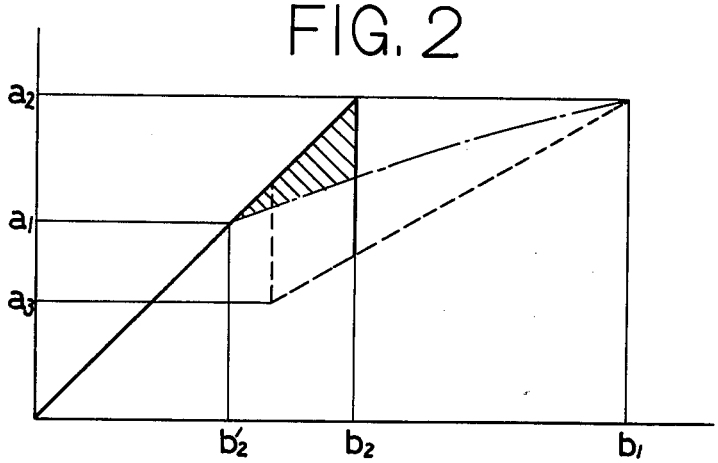
FIG. 2 illustrates air pump discharge pressure characteristics associated with relief valves of the prior art and the present invention.

FIG. 2 illustrates air pump discharge pressure characteristics associated with relief valves of the prior art and the present invention, with the ordinate and abscissa standing for the discharge pressure and rotating speed of the pump, respectively. With the conventional relief valve, once the maximum pressure ($a_2$) of the air pump is determined, the relief initiating pressure ($a_1$) must be set at a lower level than the maximum. As will be seen in the figure, raising the relief pressure would cause the allowable pressure to be exceeded when the air pump runs at the maximum speed. This is undesirable from the viewpoint of the durability of the air pump. In order for the discharge pressure of the air pump not to exceed the permissible limit at the maximum revolving speed $b_1$ of the pump, the relief valve must begin to open at a lower discharge pressure $a_1$ at an air pump rotating speed $b_2'$, with the consequence that restrictions are placed on the available amount of air. Meanwhile, this invention provides a secondary air control system including a relief valve characterized by a mechanism adapted to control the valve in the folowing manner: The opening of the relief valve is started by the allowable discharge pressure $a_2$ at the rotating speed $b_2$. By setting the relief initiating pressure at such a relatively high level, secondary air can be supplied in necessary quantities for exhaust gas purification. Also, once the discharge pressure reaches the relief pressure level as the revolving speed of the air pump increases, the relief valve remains open until the discharge pressure decreases to a much lower level ($a_3$) (with large hysteresis characteristics), thus maintaining the discharge air pressure of the air pump under the limit for pump durability. In FIG. 2, a one-dot chain line represents the secondary air discharge pressure characteristics (secondary air system provided and engine load fixed) associated with the prior art relief valve, and full and dashed lines represent those associated with the relief valve embodying the present invention, the dashed line being for the relief valve as fully opened. The hatched area represents the secondary air flow increment.

Figure 3:
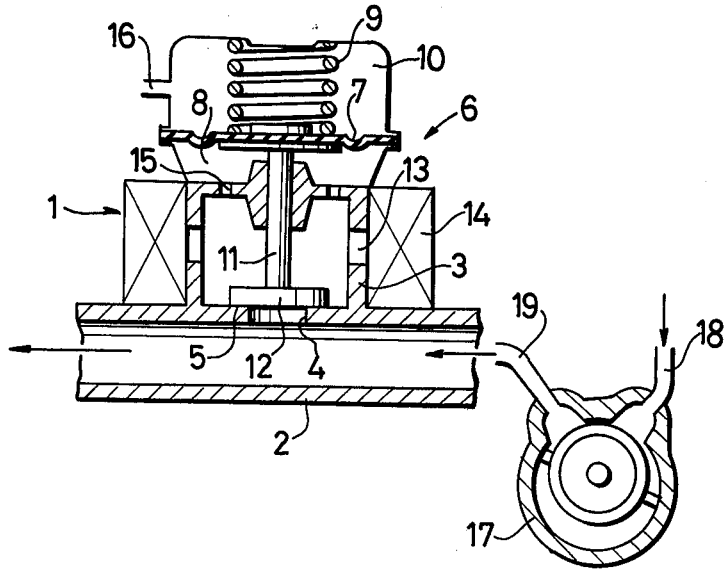
FIG. 3 shows an exemplary secondary air control relief valve embodying the present invention.

Referring to FIG. 3, there is shown an exemplary secondary air control relief valve 1 embodying the present invention. The relief valve 1 includes a valve body 2 adapted to pass secondary air therethrough in the direction of the arrow and formed with a valve casing 3. The relief valve body 2 has an air port 4 formed therein and a valve seat 5. The relief valve 1 also includes a diaphragm mechanism 6 which comprises a diaphragm chamber 8 defined between the valve casing 3 and a diaphragm 7 and an atmospheric chamber 10 containing a spring 9 and communicating with the atmosphere through an air opening 16. Secured to the diaphragm 7 is a valve stem 11 extending through the upper portion of the casing 3 and terminating with a valve head 12 biased by a spring 9 which normally forces the valve head 12 on the valve seat 5 with a predetermined pressure. Air relief ports 13 are formed through the casing 3 and communicating with the atmosphere through a silencer 14. The casing 3 has pressure transmitting ports 15 formed through the upper wall thereof and opening into the diaphragm chamber 8. An air pump 17 is driven by the engine to suck air in through an inlet port 18 and discharge pressurized air from an outlet port 19 into the valve body 2.

When the secondary air pressure exceeds a predetermined pressure so that the force acting in the air port 4 on the valve head 12 seated on the valve seat 5 overrides the biasing force of the spring 9, the valve head 12 is raised to open the air port 4. As a result, pressurized air passes through the air relief ports 13 and the silencer 14 into the open air and at the same time flows through the pressure transmitting ports 15 formed in the upper wall of the casing 3 into the diaphragm chamber 8 so that the discharge pressure acts on the diaphragm 7, thereby keeping the relief valve open until a substantially lower pressure than the valve opening pressure is reached.

Figure 4:
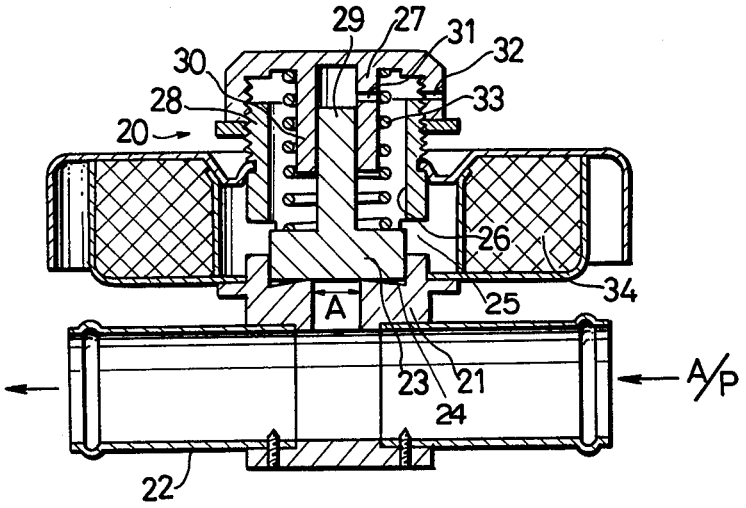
FIG. 4 shows another exemplary secondary air control relief valve embodying the present invention.
Figure 5:
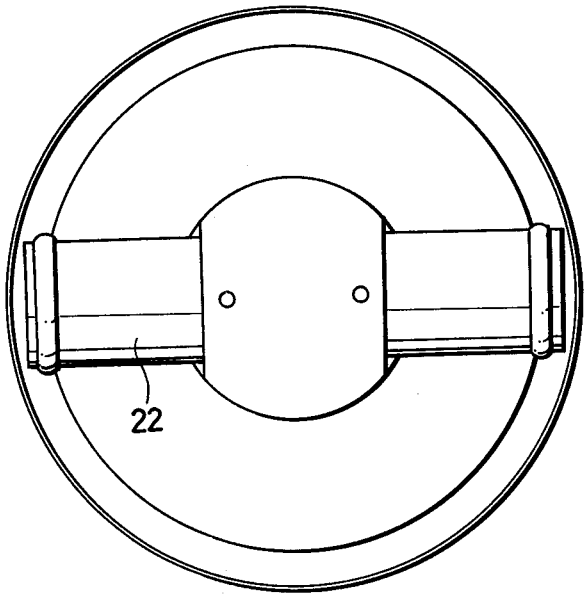
FIG. 5 is a plan of the embodiment shown in FIG. 4.

FIG. 4 illustrates another exemplary relief valve 20 employed in a secondary air control system according to this invention, and FIG. 5 is a plan of the embodiment. The relief valve 20 is circular in plan configuration and includes a valve casing 21 which is fitted in the lower portion thereof with an air injection tube 22 for passing the secondary air discharged from the pump (A/P). The casing 21 is formed, in its intermediate portion, with a valve seat 24 for seating the valve head 23, air relief ports 25 and a bore 26 adapted to receive the valve head 23 so as to allow smooth sliding thereof. The casing 21 also has a threaded top portion 28 in engagement with an adjusting threaded cap 27. The threaded cap 27 has a cylindrical extension 30 projecting inwardly toward the valve casing 21, and a valve stem 29 is slidably inserted in the extension 30, which is formed with an air bleed hole 31 adapted to allow air existing in the extension 30 to escape when the valve stem 29 is advancing thereinto. The threaded cap 27 is also formed with an air bleed hole 32 for allowing air existing in the bore 26 to escape when the valve head 23 is moving into the bore. Between the surface of the bore 26 and the outside of the cylindrical extension 30 there is provided an adjusting spring 33 having one end placed on the upper surface of the valve head 23 and an opposite end abutting the inside surface of the threaded cap 27. The spring 33 normally biases the valve head 23 in abutment with the valve seat 24. Preferably, the valve seat 24 is formed with a slightly conically sloping surface as shown, for close contact with the valve head 23.

In operation, when the pressure of the secondary air discharged from the air pump (A/P) into the air injection tube 22 exceeds the pressure set by the threaded cap 27 and the spring 33, the valve head 23 in unseated from the valve seat 24 by the force of the pressure acting on an area of the lower surface of the valve head which is equivalent to the air port area A, so that the secondary air in the injection tube 22 flows through the air relief ports 25 and the silencer 34 into the atmosphere. At the time, the valve head 23 has slid into the bore 26 and receives the air pressure on the whole area of the lower surface of the valve head, thus receiving an increased force, which compressses the spring 33 and expels air in the bore through the air bleed hole 32. Meanwhile, the valve stem 29 slides into the cylindrical extension 30, driving air in the cylinder through the bleed hole 31. Consequently, the valve head 23 is kept unseated until a lower pressure than the valve opening pressure setting is reached. As factors for the relief valve to have a desired function, the force of the adjusting spring, the pressure receiving area of the valve head, and the air relief port area can be optionally determined.

As described hereinbefore, the allowable discharge air pressure is determined in view of the allowable discharge air temperature of the air pump running at the maximum rotating speed. For this reason, at the air pump rotating speed when the opening of the relief valve is to be started which is lower than the maximum speed, the discharge air pressure at the allowable discharge air temperature may be made higher than the allowable discharge pressure determined at the maximum revolving speed of the air pump. Accordingly, as a design limit, it is also possible to set the relief valve actuating pressure at a higher level than in FIG. 2 to further increase the secondary air flow rate.

The allowable secondary air discharge pressure, though variable with the capacity of the air pump used, is generally limited to 0.6 $kg/cm^2$ in view of the internal temperature limit of the air pump. According to the present invention, however, it is practicable to utilize such pressure limit, thus allowing the discharge pressure to be set at a much higher level than 0.28 to 0.31 $kg/cm^2$ employed in the prior art system and, hence, the secondary air flow rate to be greatly increased.

What is claimed is:

1. A relief valve for use in an internal combustion engine having an exhaust system and means for injecting secondary air for treating the exhaust gas, said relief valve comprising:

a casing having a valve seat and a bore therethrough in communication with a source of secondary air that is pressurized by an air pump;

a movable valve stem having a valve head that defines a pressure receiving area at one end thereof in opposition to said valve seat, said valve head being arranged with respect to said valve seat such that the pressure receiving area of said valve changes when said relief valve is open;

a valve body having a bore therein for slidably receiving said valve head;

a cap secured to said valve body, said cap including a central extension having a bore therein for receiving said valve stem and a first air bleed hole formed through the wall of said extension, said first air bleed hole being fully opened when said valve head is in engagement with said valve seat and said relief valve is fully closed, said first air bleed hole being closed by said valve stem when said valve head moves out of engagement with said valve seat, said bore in said extension, in combination with said valve stem, defining an air damping chamber; and spring means extending between said cap and said valve head for normally biasing said valve head against said valve seat;

whereby relieved air pressure is not applied against said valve head when said relief valve is opened and the air damping chamber is operable to absorb the vibration due to the pulsating action of the air pressure caused by the output pressure of the air pump when the valve is opened.

2. The relief valve according to claim 1 wherein said cap further includes a cylindrical flange concentric with and radially spaced outwardly of said extension, said valve body being secured to said flange.

3. The relief valve according to claim 2 wherein there is further included a second air bleed hole through said flange.

4. The relief valve according to claim 2 wherein said flange and said valve body are adjustably secured to each other.

5. The relief valve according to claim 1 wherein and air relief port is provided between said valve stem and said valve body.

6. The relief valve according to claim 5 wherein there is further included silencer means surrounding said air relief port.

7. The relief valve according to claim 1 wherein said valve seat has a conically sloping surface.

* * * * *